US008720667B2

(12) United States Patent
Koga

(10) Patent No.: US 8,720,667 B2
(45) Date of Patent: May 13, 2014

(54) PRODUCT BAG UNLOADING APPARATUS

(71) Applicant: Toyo Jidoki Co., Ltd., Tokyo (JP)

(72) Inventor: Shoichi Koga, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 1 day.

(21) Appl. No.: 13/738,760

(22) Filed: Jan. 10, 2013

(65) Prior Publication Data

US 2013/0180209 A1 Jul. 18, 2013

(30) Foreign Application Priority Data

Jan. 12, 2012 (JP) ..... 2012-004511

(51) Int. Cl.
*B65G 47/26* (2006.01)

(52) U.S. Cl.
USPC ..... 198/432; 198/430

(58) Field of Classification Search
USPC ..... 198/430, 432, 468.2, 468.3
See application file for complete search history.

(56) References Cited

U.S. PATENT DOCUMENTS 4,892,113 A * 1/1990 Fattahi ..... 137/78.3
5,191,964 A * 3/1993 Spisak et al. ..... 198/447
5,381,884 A * 1/1995 Spatafora et al. ..... 198/433
6,712,196 B2 * 3/2004 Ikemoto et al. ..... 198/468.2
6,860,380 B2 * 3/2005 Watanabe et al. ..... 198/750.11
7,374,033 B2 * 5/2008 Monti ..... 198/432
8,607,963 B2 * 12/2013 Wend et al. ..... 198/430

FOREIGN PATENT DOCUMENTS

JP S61-33915 A 2/1986
JP S63-57297 B 11/1988
JP H9-254931 A 9/1997
JP 3116531 B 12/2005
JP 3984740 B 10/2007
JP 2012-12041 A 1/2012

* cited by examiner

*Primary Examiner* — James R Bidwell
(74) *Attorney, Agent, or Firm* — DLA Piper LLP (US)

(57) ABSTRACT

A product bag unloading apparatus in which two product bags (3, 4) arranged in a single row in the bag width direction are conveyed on a carry-out conveyor (5) in a single-row arrangement, with their length direction oriented in the conveyor's conveying direction. The apparatus includes a first chuck (11) for gripping one product bag (3), a second chuck (12) for gripping the other product bag (4), a pivot arm (17) pivoting through 90 degrees about a fulcrum shaft (16) with the first chuck (11) rotatably provided at a free end thereof, and a chuck translation mechanism (parallel linkage mechanism) (14) maintaining the first chuck (11) in a constant orientation at all times when the first chuck (11) is moved between a bag receiving position and a bag release position by the pivot motion of the pivot arm (17).

5 Claims, 6 Drawing Sheets

PRODUCT BAG UNLOADING APPARATUS

BACKGROUND OF THE INVENTION

1. Field of the Invention

The present invention relates to an improvement of a product bag unloading apparatus for unloading filled and sealed product bags from an intermittent transport type bag filling and packaging machine that fabricates such bags.

2. Description of the Related Art

As seen from Japanese Patent Application Publication (Kokoku) No. 63-57297 and Japanese Utility Model Registration No. 3,116,531, in a duplex-type intermittent transport type bag filling and packaging machine, two pairs of grippers that grip the right and left side edges of bags and suspend them with the mouth side up constitute a single group of grippers. Multiple groups of gripper pairs are provided at a constant pitch along a predetermined gripper traveling path, and the gripping surfaces of the two pairs of grippers belonging to the same group are provided in substantially the same plane when the respective bags are gripped. When each group of gripper pairs travels intermittently along the gripper traveling path, each one of the two pairs of grippers belonging to the same group is simultaneously supplied with a single bag (thus for a total of two (2) bags for one, same group of grippers). In the course of the subsequent packaging operations, each one of the bags gripped by the two pairs of grippers belonging to the same group is simultaneously subjected to successive packaging operations, such as opening the mouth of the bag, filling it with material to be packaged, sealing the mouth of the bag, etc. While the traveling path of the gripper pairs employed in Japanese Patent Application Publication (Kokoku) No. 63-57297 and Japanese Utility Model Registration No. 3,116,531 is circular, the traveling path can be linear or racetrack-shaped.

The advantage of a duplex-type intermittent transport type bag filling and packaging machine as described above in comparison with a simplex-type intermittent transport type bag filling and packaging machine (see Japanese Patent Application Laid-Open (Kokai) No. 61-33915, Japanese Patent Application Laid-Open (Kokai) No. 9-254931, and Japanese Patent No. 3,984,740) is its superior productivity as it can process two bags simultaneously.

When two product bags fabricated by a duplex-intermittent transport type bag filling and packaging machine are simultaneously discharged (or released by the gripper pairs) from the bag packaging machine, the bags are typically dropped onto a carry-out conveyor without getting further additional treatment and taken out of the machine in a double-row arrangement by the carry-out conveyor (Japanese Utility Model Registration No. 3,116,531).

However, subsequent treatment operations (such as sterilization, case packing, etc.) may sometimes require that the carry-out conveyor carry the bags out in a single row. For example, in Japanese Patent Application Publication (Kokoku) No. 63-57297, an intermediate conveyor, which is substantially perpendicular to the carry-out conveyor, is provided between the carry-out conveyor and the bag packaging machine; and by way of transferring product bags from the intermediate conveyor to the carry-out conveyor, the configuration used to transport product bags is converted from double-row transportation (on the intermediate conveyor) to single-row transportation (on the carry-out conveyor).

When an intermediate conveyor is employed as seen in Japanese Patent Application Publication (Kokoku) No. 63-57297, the orientation of the transported product bags is switched from the bag length direction (longitudinal direction) on the intermediate conveyor to the bag width direction on the carry-out conveyor. Accordingly, the problem with the method disclosed in Japanese Patent Application Publication (Kokoku) No. 63-57297 is that it cannot be used when the orientation of product bags conveyed in a single row must be in the length direction of the bags. In addition, another problem is that transferring (dropping) bags from the intermediate conveyor onto the carry-out conveyor shifts the orientation and position of the product bags and disturbs their alignment because of the vertical drop between the intermediate conveyor and the carry-out conveyor.

The applicant of the present application has developed and filed a patent application (Japanese Patent Application No. 2010-148099 which was filed in the U.S. with U.S. patent application Ser. No. 13/171,213) for a product bag unloading apparatus. In this product bag unloading apparatus, two product bags (arranged in a single row parallel to the bag width direction) simultaneously released from a duplex-type intermittent transport type bag filling and packaging machine are gripped by two (2) chucks, and the chucks in a single row in the thickness direction of the product bags are re-arranged during the process of being moved from a bag receiving position to a bag release position, and then the bags are released onto a carry-out conveyer. This product bag unloading apparatus makes it possible to release two product bags onto a carry-out conveyer such that the bags are aligned in a single row in the bags' lengthwise direction.

However, in product bag unloading apparatus of Japanese Patent Application No. 2010-148099 (Japanese Patent Application Laid-Open (Kokai) No. 2012-12041), two (2) product bags are gripped by two pairs of chucks, and when the chucks are moved from the bag receiving position to the bag release position, the chuck support frame supporting the two pairs of chucks at both ends swings and rotates within the horizontal; plane, as a result, the release position must be set at a position somewhat away from the bag receiving position so as to prevent interference from occurring between the product bags gripped by the chucks and the gripper pairs of the bag filling and packaging machine (see FIGS. 5 and 11 of this art) during the transferring operation. For this reason, the distance that the chucks are moved (and the distance that the product bags gripped by the chucks are transported) increases, and this creates problems in terms of improvement in productivity (increasing the rate of product bag unloading) and scaling down of the size of the entire packaging system including the product bag unloading apparatus. In addition, the construction of the product bag unloading apparatus of this art is complicated because of simultaneous transportation of two pairs of chucks gripping product bags from the bag receiving position to the bag release position.

BRIEF SUMMARY OF THE INVENTION

The present invention was made by taking into account the problems of the product bag unloading apparatus described in the above-described Japanese Patent Application No. 2010-148099 (U.S. patent application Ser. No. 13/171,213), and it is an object of the present invention to provide a product bag unloading apparatus which, in the same manner as the product bag unloading apparatus of Japanese Patent Application No. 2010-148099 (U.S. patent application Ser. No. 13/171, 213), is capable of moving two product bags arranged in a single row parallel to a bag width direction onto a carry-out conveyer in a single-row arrangement with their length direction oriented in the direction of transport, and, at the same time, has a simple construction, and the distance chucks are moved, as well as the distance product bags are transported, is shortened.

The above object is accomplished by a unique structure of the present invention for a product bag unloading apparatus wherein two filled and sealed product bags, which respectively have their left and right side edges gripped by separate gripper pairs and hung with the mouth side up at the same height and arranged in a single row at a predetermined distance from each other in the bag width direction, are dropped in a single row in the direction of the length of the bags on a carry-out conveyor; and in the present invention, the unloading apparatus is provided with:

- a chuck that opens and closes in a downward direction and grips, from above, one of two product bags gripped by the gripper pairs and stopped at a predetermined stop position;
- a chuck moving mechanism that reciprocates (moves) the chuck between a bag receiving position for the above-described one product bag and a bag release position for that product bag located away from the bag receiving position; and
- a chuck translation mechanism that maintains the chuck in a constant orientation at all times when the chuck reciprocates (or is moved) between the bag receiving position and the bag release position.

In the above structure, the chuck moving mechanism comprises:

- a vertical fulcrum shaft which is coupled to a drive source and makes a reciprocating rotary motion about the center position of the other product bag of the two product bags as viewed in plan and at a position above the two product bags stopped at a predetermined stop position, and
- a pivot arm which is at its one end fixedly secured to the fulcrum shaft and pivots, by the reciprocating rotary motion of the fulcrum shaft, through a 90-degree range about the fulcrum shaft within a horizontal plane at a position above the two product bags stopped at the predetermined stop position.

The chuck described above is provided at a free end of the pivot arm so as to be rotatable within a horizontal plane and the linear distance from its center of rotation to the center of the fulcrum shaft is set equal to the distance between the two product bags stopped at the predetermined stop position. More specifically in terms of the structure, a chuck-supporting shaft is rotatably provided at the free end of the pivot arm, and the linear distance from its center of rotation to the center of the fulcrum shaft is set equal to the distance between the two product bags stopped at the predetermined stop position, and further the chuck is provided at the lower end of the chuck-supporting shaft. It should be noted that the "distance between the two product bags" is a distance between the centers in the bag width direction of the two product bags which are next to each other in a single row in the bag width direction.

The chuck translation mechanism described above comprises, for example,

- a follower link fixedly secured to the chuck-supporting shaft;
- a fixed link fixedly secured in the vicinity of the fulcrum shaft; and
- a connecting link with one end thereof connected to the follower link and another end thereof connected to the fixed link.

In this structure of the chuck translation mechanism, the positional relationship among the fulcrum shaft, the chuck-supporting shaft, and two connecting pins at both ends of the connecting link is configured to form a parallelogram at all times when their axial centers are connected with (imaginary) straight lines in a horizontal plane. As a result, the pivot arm forms a parallel linkage mechanism with the connecting link, fixed link, and follower link.

If necessary, the product bag unloading apparatus can be provided with another chuck that grips the other product bag of the two product bags held by the gripper pairs and stopped at a predetermined stop position so that this chuck grips as well, from above, the bag at a location in the vicinity of the mouth. In this structure, this chuck and the chuck describe previously can be made to serve as cooling plates for cooling the seal portions of the product bags.

As seen from the above, according to the product bag unloading apparatus according to the present invention, two (2) product bags arranged in a single row in the bag width direction can be transferred onto a carry-out conveyor so that the bags form a single-row arrangement in their length direction oriented in the conveying direction of the carry-out conveyor.

In addition, in the product bag unloading apparatus of the present invention, only one product bag of the two product bags that are in a single row in the bag width direction is gripped by a chuck and moved from a bag receiving position to a bag release position. Accordingly, the construction of the apparatus is simple, and the distance the chuck is moved from the bag receiving position to the bag release position can be shortened. As a result, the entire packaging system that includes the product bag unloading apparatus can be more compact and improve productivity.

When the product bag unloading apparatus is provided with two pairs of chucks, the timing of release and transfer of the other product bag of the two product bags onto the carry-out conveyer can be also set freely.

In addition, when both chucks are made to serve double duty as a pair of cooling plates for cooling the seal portions of the mouths of the product bags, there is no need to provide a seal portion cooling step or seal portion cooling means (a pair of openable/closable cooling plates) in the bag filling and packaging machine, allowing the bag filling and packaging machine to be made more compact and fast in its operation; and in the product bag unloading apparatus, because the cooling of the seal portions of the two bags can be carried out during the time that the chuck holding one of the two bags is moved, productivity is not hindered by the cooling action to the seal portions.

DETAILED DESCRIPTION OF THE INVENTION

A product bag unloading apparatus according to the present invention will be described in detail below with reference to FIG. 1 through FIG. 6.

Figure 1:
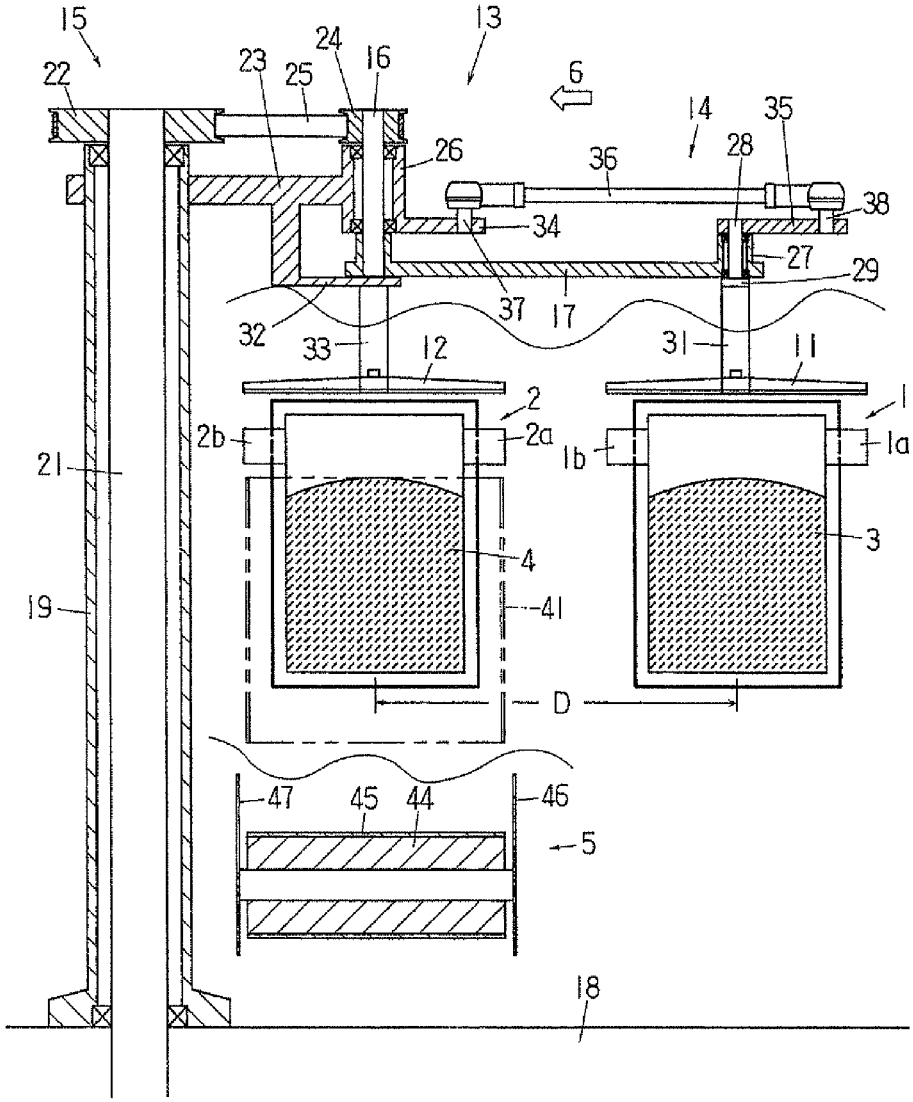
FIG. 1 is a partial cross-sectional front view of a product bag unloading apparatus according to the present invention with a chuck thereof gripping one of two bags located in a bag receiving position (both chucks being in an open state)
Figure 2:
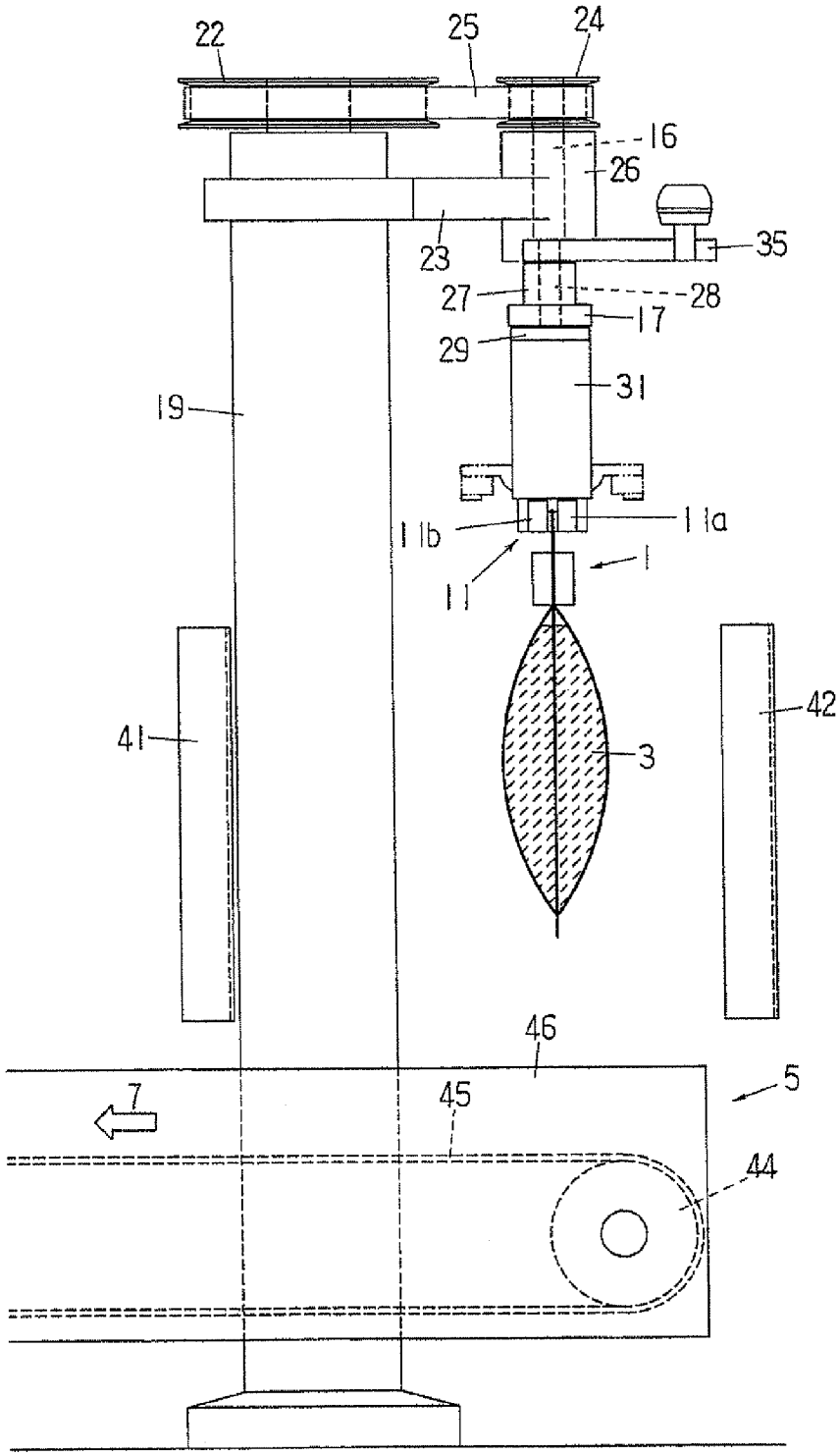
FIG. 2 is a side view thereof (both chucks being in a closed state)
Figure 3:
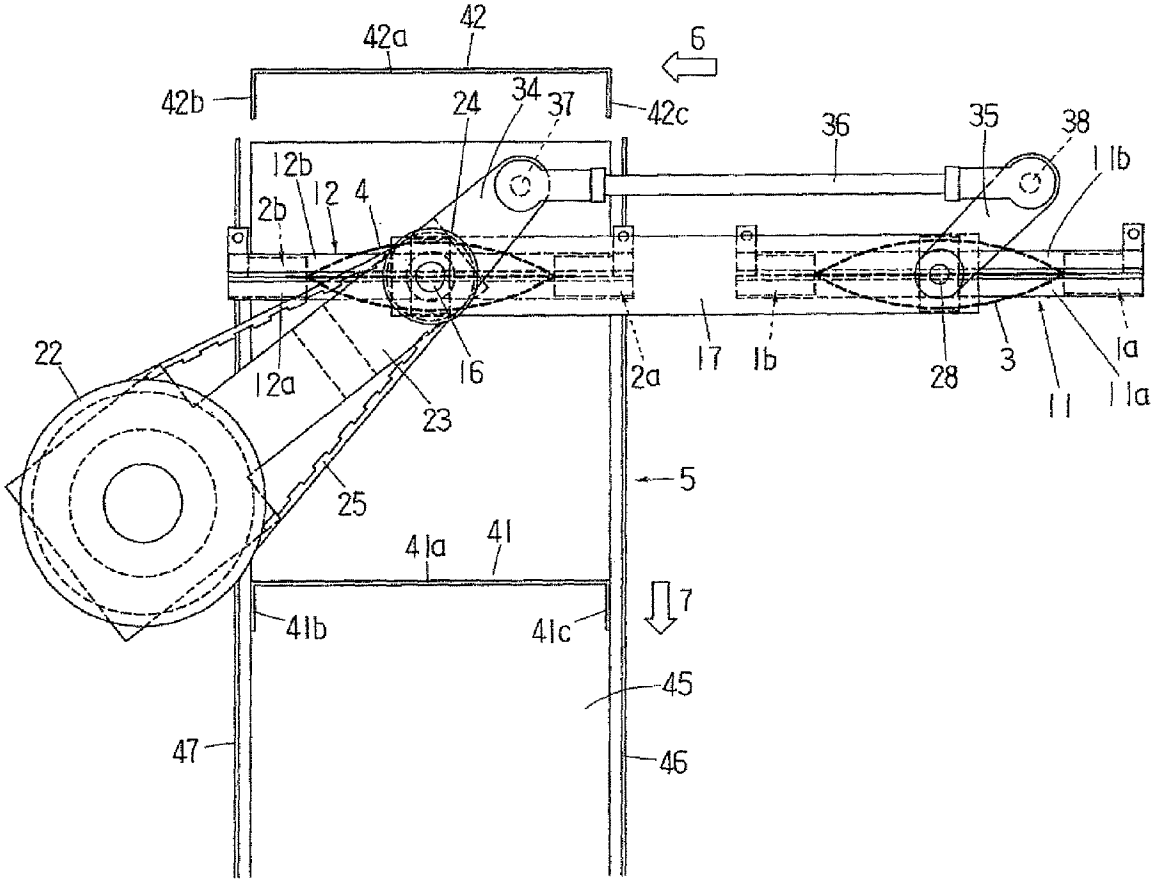
FIG. 3 is a top view thereof (both chucks being in a closed state)

The product bag unloading apparatus is designed so that when two gripper pairs 1, 2 of a duplex-type intermittent transport type bag filling and packaging machine (only gripper pairs 1, 2 thereof are shown in FIGS. 1 through 3) stop in a predetermined bag stop position (which is the position shown in FIGS. 1 through 3), the product bag unloading apparatus receives filled and sealed product bags 3, 4, which are manufactured by the bag filling and packaging machine, from the gripper pairs 1, 2 and releases them onto a carry-out conveyer 5.

The intermittently traveling gripper pairs 1, 2 have a circular traveling path (in FIGS. 1 and 3, the direction of travel is indicated by arrow 6) as in, for example, Japanese Patent Application Publication (Kokoku) No. 63-57297 and Japanese Utility Model Registration No. 3116531. The product bags 3, 4 are gripped at left and right edges by the gripper pairs 1, 2, respectively, and hung with mouth side up at the same height, and they are arranged in a single row in the bag width direction (as best shown in FIG. 3) at a predetermined distance D (which is the distance between the center locations of the product bags 3, 4 in the width direction) from each other. The conveying direction of the carry-out conveyer 5 (indicated by arrow 7 in FIGS. 2 and 3) is parallel to the thickness direction of the product bags 3, 4 gripped by the gripper pairs 1, 2.

In the intermittent transport type bag filling and packaging machine, the gripper pairs 1, 2 are those known generally, and they grip the right and left edges of the product bags 3, 4 at locations slightly below the mouths and are intermittently rotated with every two pairs constituting a single group. The right and left gripper elements 1*a* and 1*b* of the gripper 1 and the right and left gripper elements 2*a* and 2*b* of the gripper 2 make a symmetrical structure, and as seen from FIG. 4 each gripper element comprises a fixed gripping member 8 on the inside and a movable gripping member 9 on the outside. The movable gripping member 9, which has a hook-like shape in top view, swivels open and close in the horizontal plane outwardly and inwardly relative to the outside of the fixed gripping member 8. When the movable gripping members 9 are turned inward and closed, the product bags 3, 4 are gripped between the movable gripping member 9 and the fixed gripping member 8; and when the movable gripping member 9 is turned outward and opened, the product bags 3, 4 are released from the gripping elements or from the grippers. When bags are gripped, all the gripping surfaces of the right and left gripper elements 1*a*, 1*b*, 2*a*, 2*b* of the two pairs of grippers 1, 2 belonging to the same group (made up of a fixed gripping member 8 and a movable gripping member 9) are provided such that they are located in a generally same vertical plane. Consequently, the product bags 3, 4 gripped by the gripper pairs 1, 2 form a single row in the bag width direction as seen from FIG. 3.

As illustrated in FIGS. 1 through 3, the product bag unloading apparatus is provided with chucks 11, 12, a chuck moving mechanism 13 which moves the chuck 11 between a bag receiving position where the product bag 3 is received by the chuck 11 and a bag release position located away from the bag receiving position, and a chuck translation mechanism 14 which maintains the chuck 11 in a constant orientation at all times when the chuck 11 reciprocates (or is moved) between the bag receiving position and the bag release position. For the chuck 12, its bag receiving position and bag releasing position are at the same location.

The chuck moving mechanism 13 for moving the chuck 11 comprises a fulcrum shaft 16, which is disposed in a position above the product bags 3, 4 stopped in the predetermined bag stop positions, and a pivot arm 17, which is at its one end fixedly secured to the lower end portion of the fulcrum shaft 16. The fulcrum shaft 16 is disposed vertically at a center position of the product bag 4 as viewed in plan or from above, and it is connected to a drive source, not shown, through a driving mechanism 15 to make a reciprocating (two-way) rotary motion. The pivot arm 17, by the reciprocating rotary motion of the fulcrum shaft 16, pivots through a 90-degree range within a horizontal plane about the fulcrum shaft 16 above the product bags 3, 4.

The driving mechanism 15 for the fulcrum shaft 16 is comprised of a stand 19 set upright on a pedestal 18, a drive shaft 21 which is rotatably installed inside the stand 19 and connected to a drive source, not shown, to make a reciprocating rotary motion, a first pulley (timing pulley) 22 which is fixedly secured to the upper end of the drive shaft 21, a support arm 23 which is fixedly secured to the upper portion of the stand 19, a second pulley (timing pulley) 24 which is fixedly secured to the upper end of the fulcrum shaft 16, and a timing belt 25 provided between the first and second pulleys 22, 24. The support arm 23 has a fulcrum shaft support section 26, and the fulcrum shaft 16 is rotatably supported by this fulcrum shaft support section 26. When the drive shaft 21, driven by the drive source, is rotated back and force, the fulcrum shaft 16 is rotated back and force or rotated reciprocally and thus causes the pivot arm 17 to pivot via the first pulley 22, timing belt 25, and second pulley 24.

The pivot arm 17 has at its free end a supporting shaft support section 27, and a chuck-supporting shaft 28 is vertically and rotatably supported by this supporting shaft support section 27. The location of installation of the chuck-supporting shaft 28 is set such that the linear distance from its rotary center to the rotary center of the fulcrum shaft 16 is equal to the distance D that is between the two product bags 3, 4 stopped at the predetermined stop position.

An air cylinder 31 used for opening and closing the chuck 11 is fixedly secured to the lower part of the chuck-supporting shaft 28 through a chuck attachment unit 29 with the chuck 11 installed underneath. The chuck 11, which as seen from FIG. 2 is made up of a pair of downwardly opening and closing jaws 11*a*, 11*b*, is opened and closed under the action of an air cylinder 31 (in FIG. 2, the solid lines indicate the closed state of the chuck 11 and the two-dot chain lines indicate the open state of the chuck 11). When closed, the chuck 11 grasps with the jaws 11*a*, 11*b* the sealed mouth of the product bag 3 from above for substantially the entire width of the bag 3.

A chuck attachment unit 32 is formed on the support arm 23, an air cylinder 33 used for opening and closing the chuck 12 is fixedly secured to the lower part of the chuck attachment unit 32, and the chuck 12 is installed underneath. The chuck 12, as seen from FIG. 2, is made up of a pair of downwardly opening and closing jaws 12*a*, 12*b*, and is, similarly to the chuck 11, opened and closed by the action of an air cylinder 33. When closed, the chuck 12 grasps with the jaws 12*a*, 12*b* the sealed mouth of the product bag 4 from above for substantially the entire width of the bag 4. The center of the chuck 12 in the width direction coincides with the rotary center of the fulcrum shaft 16.

The jaws 11*a*, 11*b* of the chuck 11 and the jaws 12*a*, 12*b* of the chuck 12 are cooled by means not illustrated in the figure.

Furthermore, a fixed link 34 is formed as part of the support arm 23 at the distal end portion thereof (in the vicinity of the fulcrum shaft 16), and a follower link 35 is fixedly secured to the upper end of the chuck-supporting shaft 28. The chuck translation mechanism 14 is made up of the fixed link 34, the follower link 35, and a connecting link 36 with one end thereof connected to the fixed link 34 and another end thereof connected to the follower link 35. The positional relationship between the fulcrum shaft 16, the chuck-supporting shaft 28, and the connecting pins 37, 38 at both ends of the connecting link 36 is configured such that a parallelogram is formed at all times when their axial centers are connected with (imaginary) straight lines in the horizontal plane. Accordingly, the pivot arm 17 forms a parallel linkage mechanism with the connecting link 36, the fixed link 34, and the follower link 35.

In addition, as an auxiliary means for the product bag unloading apparatus, chutes 41, 42, which guide the product bags 3, 4 released from the chucks 11, 12 onto the conveyor 5, as well as a shutter 43, which temporarily holds the product bag 3 released from the chuck 11 on the chute 41, are provided above and in close proximity to the carry-out conveyor 5. The chutes 41, 42 are enclosure-like members respectively made up of bottom walls 41*a*, 42*a* and side walls 41*b*, 41*c*, 42*b*, 42*c*, and they travel at an appropriate timing in a slanted posture from a vertical retracted position (which is illustrated with imaginary lines in FIG. 6) to a bag receiving position (which is illustrated with solid lines in FIG. 6) and then go back to the retracted position when moved in the opposite direction. The shutter 43 likewise pivots at proper intervals from the retracted position of FIG. 6 (which is illustrated with imaginary lines in FIG. 6) towards a holding position (which is illustrated with solid lines in FIG. 6) and then goes back by pivoting in the opposite direction.

The carry-out conveyor 5 is a belt conveyor, and it is made up of a pair of rotating rollers (only one roller 44 is illustrated), a conveyor belt 45, which is provided between the two rollers 44, and side guide plates 46, 47 installed on both sides of the conveyor belt 45.

One example of operation of the above-described product bag unloading apparatus and its auxiliary means will be described below.

(1) As shown in FIGS. 1 through 3, when the gripper pairs 1, 2 of the intermittent transport type bag filling and packaging machine that grip the product bags 3, 4 come to a stop, the pivot arm 17 is at the starting point of its pivot motion, and the chuck 11 is also at the starting point of motion. In other words, the pivot arm 17 is positioned directly above the product bags 3, 4 forming a single row in the bag width direction and is in parallel to the row of the product bags 3, 4. In addition, the chucks 11, 12 of the product bag unloading apparatus are directly above the product bags 3, 4 and in a single row in the width direction of the product bags 3, 4 (alternatively, it can be said that the chucks 11, 12 are in a single row in the width direction of the grasping surfaces of the chucks 11, 12). The position of the chuck 11 at this point is the bag receiving position.

(2) As shown in FIG. 1 (and FIG. 2 by the two-dot chain line), before gripping the product bags 3, 4, the chucks 11, 12 remain open.

Next, the air cylinders 31, 33 are actuated to close the chucks 11, 12, so that the chucks 11, 12 grip the mouths of the product bags 3, 4 from above as illustrated in FIGS. 2 and 3. Until the chucks 11, 12 are next opened, the mouths of the product bags 3, 4 are cooled by the chucks 11, 12, which serve double duty as cooling plates.

Next, the gripper pairs 1, 2 of the intermittent transport type bag filling and packaging machine are opened, and the product bags 3, 4 are released, which completes transfer of the product bags 3, 4 from the gripper pairs 1, 2 of the intermittent transport type bag filling and packaging machine to the chucks 11, 12 of the product bag unloading apparatus.

Figure 4:
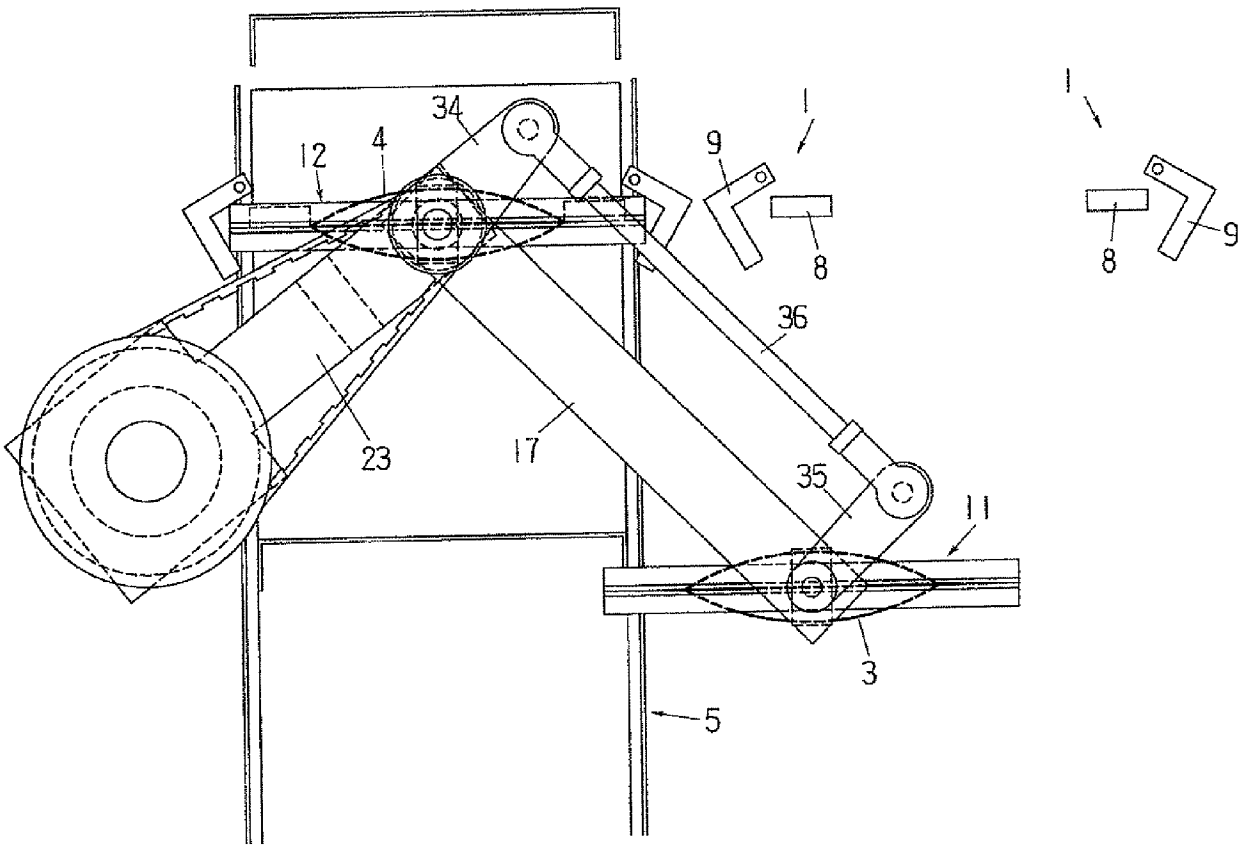
FIG. 4 is a top view of the product bag unloading apparatus with a chuck gripping one of two bags being moved from a bag receiving position to a bag release position.

(3) Then, the pivot arm 17 starts its rotational motion. When the pivot arm 17 thus starts its rotational motion (rotating clockwise in FIG. 3), the chuck 11 also begins to move. FIG. 4 shows the position of the chuck 11 and the pivot arm 17 (pivoting angle: 45°) when the pivot arm 17 is in the process of its pivot motion.

As described above, the pivot arm 17 forms a parallel linkage mechanism with the connecting link 36, the fixed link 34, and the follower link 35, Therefore, while the pivot arm 17 is making its pivot motion, the parallel relationship between the fixed link 34 and the follower link 35 does not change, and the follower link 35 is moved without changing its orientation. In other words, the follower link 35 does not make a rotational motion but makes translational motion only. In the same manner, the chuck 11, which is fixedly secured to the follower link 35, and the product bag 3, which is held by the chuck 11, are subject to translational motion, so that their orientation (the orientation of the grasping surfaces of the chuck 11 and the orientation of the width direction of the product bag 3) does not change.

Figure 5:
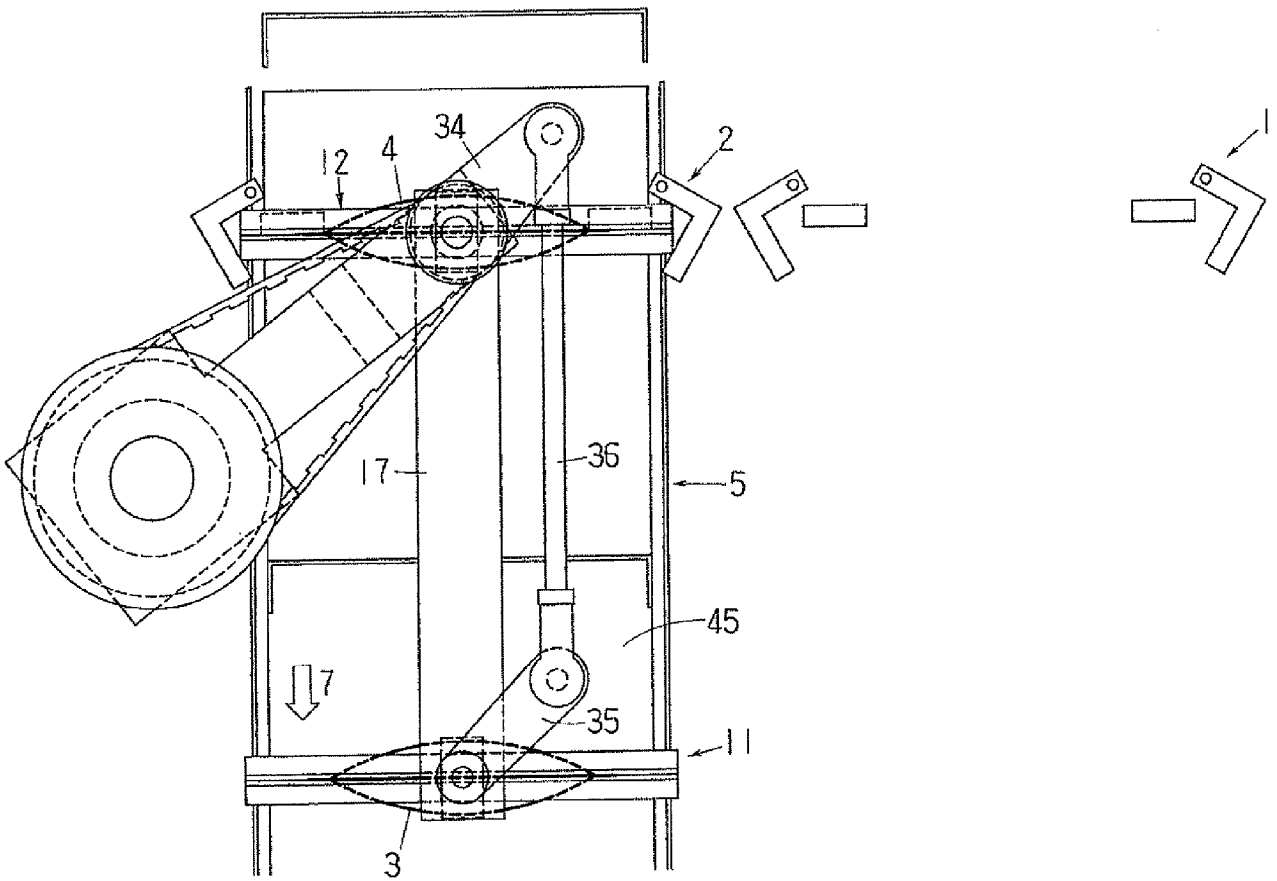
FIG. 5 is a top view of the product bag unloading apparatus with the chuck gripping one of two bags arrived at the bag release position.

(4) As shown in FIG. 5, when the pivot arm 17 arrives at the end point of its pivot motion (the position reached by pivoting 90°), the chuck 11 also arrives at the end point of its travel motion. The end point of travel of the chuck 11 is the bag release position.

At such time, the pivot arm 17 becomes parallel to the conveying direction of the carry-out conveyor 5 (indicated by arrow 7). The orientation of the grasping surfaces of the chuck 11 and the orientation of width direction of the product bag 3 are normal to the direction of transport of the carry-out conveyor 5, just as it was before the travel motion started. During this travel of the chuck 11 and product bag 3, the chuck 12 and product bag 4 do not move and remain at their positions. As a result, the chucks 11, 12 make a single row along the thickness direction of the product bags 3, 4, and the product bags 3, 4 also make a single row along the thickness direction thereof (it can be said alternatively that the chucks 11, 12 are in a single row in a direction perpendicular to their grasping surfaces, and the product bags 3, 4 are in a single row in a direction perpendicular to the grasping surfaces of the chucks 11, 12).

Figure 6:
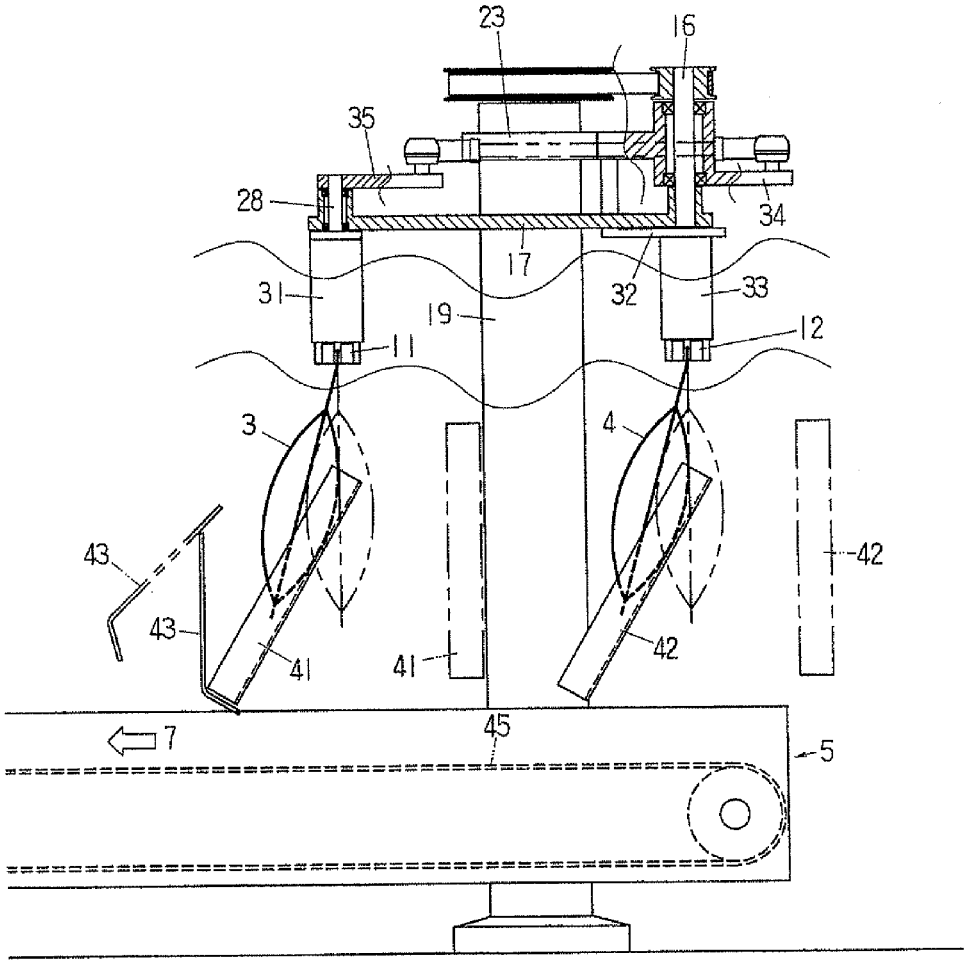
FIG. 6 is an explanatory diagram illustrating a movement of two product bags when both chucks release the product bags onto a carry-out conveyor.

(5) Subsequently, as shown in FIG. 6, the chutes 41, 42 are moved from the retracted position to the bag receiving position while being slanted, and the shutter 43 pivots from the retracted position towards the holding position. The moving chutes 41, 42 abut, in a slanted posture, the rear side of the product bags 3, 4 (the rear side as viewed in the direction of transport of the carry-out conveyor 5, indicated by arrow 7), thereby causing the product bags 3, 4 to be inclined as shown in solid lines.

Next, the air cylinders 31, 33 are actuated to simultaneously open the chucks 11, 12, and as a result the product bags 3, 4 are dropped onto the chutes 41, 42. The product bag 3 on the chute 41 is stopped and temporarily held by the shutter 43 in the chute 41. Meanwhile, the product bag 4, which has been dropped on the chute 42, slides down the chute 42 and rides on the conveyor belt 45 of the carry-out conveyor 5, transported such that the length direction of the bag is oriented in parallel to the direction of transport.

(6) Once the chucks 11, 12 are opened, the pivot arm 17 starts pivoting back motion, and the chuck 11 starts its return motion. When the chuck 11 is moved back, the chuck 11 is subject to translational motion under the action of the parallel linkage mechanism, and therefore, the orientation of the chuck 11 (or the orientation of the grasping surfaces of the chuck 11) does not change.

During this movement, the gripper pairs 1, 2 of the intermittent transport type bag filling and packaging machine start moving towards a next stop position at an appropriate timing, and at the same time, next two gripper pairs that stayed in the previous stop position start moving towards the stop position illustrated in FIG. 1.

(7) The product bag 4 is, as described above, conveyed by the carry-out conveyor 5 and, at an appropriate timing after passing the position of the chute 41, the shutter 43 pivots back to the retracted position, and thus the product bag 3 slides down the chute 41, rides on the conveyor belt 45 of the carry-out conveyor 5 and is transported such that the length direction of the bag is oriented in parallel to the direction of transport. It should be noted that the purpose of temporarily holding the product bag 3 on the chute 41 by the shutter 43 is to prevent the product bags 3, 4 from piling up one on the other on the conveyor belt 45 (which would occur when product bags are bulky in terms of length dimensions). Thus, even if the product bags 3, 4 simultaneously slide through the chutes 41, 42 onto the conveyor belt 45, so long as the product bags 3, 4 do not pile up on the conveyor belt 45, actuation of the shutter 43 can be omitted (or the shutter 43 can be unnecessary).

Once the product bags 3, 4 have slid through the chutes 41, 42, the chutes 41, 42 are moved back to the retracted position at an appropriate timing.

It should be noted that the construction and operation of the product bag unloading apparatus of the present invention is not limited to those described above. Various modifications shown below can also be used.

(A) Although the above-described product bag unloading apparatus is provided with chuck 12 for grasping the product bag 4, there is no need to provide the chuck 12. In a structure without the chuck 12, when the gripper pair 2 of the intermittent transport type bag filling and packaging machine opens, the product bag 4 immediately (or without waiting for the motion of the bag 3) drops onto the chute 42, slides down the chute 42, and rides on the conveyor belt 45 of the carry-out conveyor 5.

(B) In the above-described product bag unloading apparatus, a parallel linkage mechanism is employed as a chuck translation mechanism. However, other mechanisms having similar functionality can be used as appropriate. For example, the chuck-supporting shaft 28 can be rotated by the rotational motion of the pivoting arm 17 using a gear train composed of multiple gears (such as that seen in Japanese Patent Application No. 2010-148099 (U.S. patent application Ser. No. 13/171,213)) and a servo motor, etc.

(C) In the above-described product bag unloading apparatus, the chucks 11, 12 open simultaneously. However, the timing, with which the chucks 11, 12 are opened, can be shifted. For example, the timing of opening of the chuck 11 can be delayed so that the chuck 11 opens at an appropriate timing after the product bag 4 conveyed by the carry-out conveyer 5 has passed the position of the chute 4. This arrangement as well can prevent the product bags 3, 4 from piling up one on the other on the carry-out conveyer 5. In this case, the shutter 43 for temporarily holding the product bag 3 in the chute 41 can be omitted.

(D) In the above-described example, the chutes 41, 42 are provided above and in close proximity to the carry-out conveyer 5 as an auxiliary unit for the product bag unloading apparatus. The chutes 41, 42 are, however, not essential. The bags can be directly dropped from the chucks 11, 12 onto the carry-out conveyer 5. Alternatively, as seen from FIG. 6 of Japanese Patent Application No. 2010-148099 (U.S. patent application Ser. No. 13/171,213), the carry-out conveyer 5 can be installed so as to ascend and descend between a lowered position, where the conveying surface of the conveyor 5 is lower than the lower end of the product bags 3, 4, and a raised position, where the conveying surface is higher than the lower end of the product bags 3, 4, thus raising a or lowering the conveyor at appropriate timing. With this structure as well, the orientation of the product bags 3,4 dropped onto the carry-out conveyor 5 (lengthwise orientation) can be reliably maintained and aligned with the conveying direction of the carry-out conveyor 5.

The invention claimed is:

1. A product bag unloading apparatus for arranging on a carry-out conveyor two filled and sealed product bags in a single row in a bag length direction, said bags being respectively gripped by separate gripper pairs with mouth side up at the same height and in a single row at a predetermined distance from each other in a bag width direction, wherein said product bag unloading apparatus is provided with:

a chuck that grips one product bag of the two product bags stopped at a predetermined stop position;

a chuck moving mechanism that reciprocates the chuck between a bag receiving position for said one product bag and a bag release position for said one product bag located away from the bag receiving position; and a chuck translation mechanism that maintains the chuck in a constant orientation while the chuck is moved between the bag receiving position and the bag release position; and wherein the chuck moving mechanism is comprised of:

a vertical fulcrum shaft connected to a drive source and makes reciprocating rotary motion about a center position of another product bag of the two product bags, as viewed in plan, at a position above the two product bags stopped at the predetermined stop position, and a pivot arm which is at one end thereof fixedly secured to the fulcrum shaft and, by the reciprocating rotary motion of the fulcrum shaft, pivots through a 90-degree range about the fulcrum shaft within a horizontal plane at a position above the two product bags stopped at the predetermined stop position; and said chuck is provided at a free end of the pivot arm so as to be rotatable within a horizontal plane, and a distance from a center of rotation thereof to a center of the fulcrum shaft is equal to a distance between the two product bags stopped at the predetermined stop position.

2. The product bag unloading apparatus according to claim 1, wherein a chuck-supporting shaft is rotatably provided at the free end of the pivot arm, a distance from a center of rotation of the chuck-supporting shaft to a center of the fulcrum shaft is equal to the distance between the two product bags stopped at the predetermined stop position, and the chuck is provided at the lower end of the chuck-supporting shaft.

3. The product bag unloading apparatus according to claim 2, wherein:

the chuck translation mechanism is comprised of:

a follower link provided on the chuck-supporting shaft, a fixed link provided in the vicinity of the fulcrum shaft, and a connecting link with one end thereof connected to the follower link and another end thereof connected to the fixed link; and a positional relationship among the fulcrum shaft, chuck-supporting shaft, and connecting pins at both ends of the connecting link is configured such that a parallelogram is formed at all times when axial centers thereof are connected with straight lines in a horizontal plane.

4. The product bag unloading apparatus according to claim 1, further comprising another chuck disposed underneath the fulcrum shaft, said another chuck gripping said another product bag of the two product bags stopped at the predetermined stop position.

5. The product bag unloading apparatus according to claim 4, wherein said chucks serve double duty as cooling plates for cooling seal portions of said product bags.

* * * * *